US009130284B2

(12) United States Patent
Onuma et al.

(10) Patent No.: US 9,130,284 B2
(45) Date of Patent: Sep. 8, 2015

(54) CRIMP TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/813,898

(22) PCT Filed: Jun. 8, 2011

(86) PCT No.: PCT/JP2011/063158

§ 371 (c)(1),
(2), (4) Date: Feb. 1, 2013

(87) PCT Pub. No.: WO2012/017736

PCT Pub. Date: Feb. 9, 2012

(65) Prior Publication Data

US 2013/0130566 A1 May 23, 2013

(30) Foreign Application Priority Data

Aug. 4, 2010 (JP) ..... 2010-175170

(51) Int. Cl.
*H01R 4/28* (2006.01)
*H01R 4/18* (2006.01)

(52) U.S. Cl.
CPC ..... *H01R 4/28* (2013.01); *H01R 4/185* (2013.01); *H01R 4/188* (2013.01)

(58) Field of Classification Search
CPC ..... H01R 4/188; H01R 4/185; H01R 4/18; H01R 4/28; H01R 4/184; H01R 4/203; H01R 4/2495; H01R 4/62
USPC ..... 439/882, 877
See application file for complete search history.

(56) References Cited

U.S. PATENT DOCUMENTS 2,735,997 A * 2/1956 Peterson ..... 439/882
3,496,520 A * 2/1970 Reynolds ..... 29/882
3,594,702 A * 7/1971 Frey ..... 439/442
3,990,143 A 11/1976 Dittmann et al.
5,370,560 A * 12/1994 Ito ..... 439/877

(Continued)

FOREIGN PATENT DOCUMENTS

CN 1360368 A 7/2002
JP 55-096575 A 7/1980

(Continued)

OTHER PUBLICATIONS

European Search report for EP11814366.8 dated Dec. 3, 2013.

(Continued)

*Primary Examiner* — Briggitte R Hammond
(74) *Attorney, Agent, or Firm* — Sughrue Mion, PLLC

(57) ABSTRACT

A crimp terminal (10) includes a conductor crimp portion (12) having a cross section formed into a U-shape by a bottom plate (13) and a pair of conductor crimping pieces (14, 14) provided to extend on both sides of the bottom plate (13) and crimped to wrap a conductor (Wa) of an electric wire (W) disposed on an inner surface (13*a*) of the bottom plate (13). The conductor crimp portion (12) is crimped and connected to the conductor (Wa) and includes serrations (16) at respective lattice points of a lattice (21, 22, 23) assumed in an inner surface (13*a*, 14*a*) of the conductor crimp portion (12) and obliquely crossing in a longitudinal direction of the conductor (Wa). The serrations (16) are consisted of cylindrical recesses having the same shape.

1 Claim, 7 Drawing Sheets

(56) References Cited

U.S. PATENT DOCUMENTS

| | | | | |
|---|---|---|---|---|
| 6,056,605 | A * | 5/2000 | Nguyen et al. | 439/882 |
| 8,177,591 | B2 * | 5/2012 | Okamura et al. | 439/877 |
| 8,246,394 | B2 * | 8/2012 | Ono et al. | 439/877 |
| 8,485,853 | B2 * | 7/2013 | Seifert et al. | 439/882 |
| 8,622,774 | B2 * | 1/2014 | Seifert et al. | 439/882 |
| 2011/0003518 | A1 | 1/2011 | Ono et al. | |

FOREIGN PATENT DOCUMENTS

| | | | |
|---|---|---|---|
| JP | 55-108192 | A | 8/1980 |
| JP | 5842951 | A | 9/1983 |
| JP | 11-515137 | A | 12/1999 |
| JP | 2009-245695 | A | 10/2009 |
| JP | 2010-003467 | | 1/2010 |
| JP | 2010067478 | A | 3/2010 |
| WO | 2009154109 | A1 | 12/2009 |

OTHER PUBLICATIONS

Office Action issued on Oct. 7, 2014 in the counterpart Japanese Patent Application No. 2010-175170.

Communication dated Oct. 27, 2014, issued by the State Intellectual Property Office of the People's Republic of China in corresponding Chinese Application No. 201180038375.1.

Office Action issued Jul. 15, 2014 in counterpart Japanese Patent Application No. 2010-175170.

Communication dated Jan. 26, 2015 from the European Patent Office in counterpart application No. 11814366.8.

* cited by examiner

CRIMP TERMINAL

TECHNICAL FIELD

The present invention relates to a crimp terminal used for connection with an electric wire.

BACKGROUND ART

As a crimp terminal used for connection with an electric wire, there has been known one illustrated in FIG. 1 (for example, see Patent Document 1). This crimp terminal 110 is provided with an electrical connection portion 111 electrically connectable with a mating terminal (not illustrated), a conductor crimp portion 112 having a substantially U-shaped cross section and crimped and connected to a conductor (core wire) Wa formed by twisting a plurality of wires Wc of the electric wire W together, and a coated crimping portion 115 fixed to a coated portion Wb of the electric wire W. An inner surface 112*a* of the conductor crimp portion 112 has three recessed groove-shaped serrations 118 extending in a direction perpendicular to a longitudinal direction of the conductor Wa.

When the conductor Wa of the electric wire W is crimped to the conductor crimp portion 112 of the crimp terminal 110, the wire Wc of the conductor Wa is pushed into the recessed groove-shaped serration 118 while being deformed, and at this time, a serration edge 117 being an edge of the serration 118 triggers breakage of an oxide film on a surface of the wire We of the conductor Wa to generate a newly formed surface, and, thus, to firmly adhere the newly formed surface and the conductor crimp portion 112 of the crimp terminal 110 to each other, whereby electrical connection is achieved.

CITATION LIST

Patent Literature

Patent Literature 1: JP 2009-245695 A (FIG. 1)

SUMMARY OF INVENTION

In the above conventional crimp terminal 110, variation is large when the conductor of the electric wire is crimped to the crimp portion of the crimp terminal. For example, when a crimping force is insufficient (compressibility is too low), a newly formed surface is not sufficiently generated, and the electrical connection resistance between the crimp terminal and an oxide film of the electric wire is high and becomes unstable. If the crimping force is too large (the compressibility is too high), damage to the conductor is large (the damage easily increases, especially in the case of a conductor formed by twisting and bundling thin wires), and there is a problem that mechanical connection strength (fixing strength) between the crimp terminal and the electric wire is low and is easily varied.

Thus, instead of the recessed groove-shaped serrations 118, there has been considered a configuration as illustrated in FIGS. 2 and 3 in which circular serrations 116 constituted of a plurality of cylindrical recesses are arranged in series at regular intervals. By virtue of the circular serrations 116, a serration edge length can be secured in comparison with the recessed groove-shaped serrations 118, and therefore, the newly formed surface can be generated even if the crimping force is not increased, whereby the damage to the conductor can be reduced.

However, by merely arranging the circular serrations 116 in series at regular intervals, it is difficult to suppress the variation when the conductor of the electric wire is crimped to the crimp portion of the crimp terminal.

An object of the present invention is to provide a crimp terminal which reduces variation in an operation of crimping a conductor of an electric wire to a crimp portion of the crimp terminal, can stabilize an electrical connection resistance at a low level, and, at the same time, can stabilize a mechanical connection strength at a high level.

An aspect of the present invention is a crimp terminal including a conductor crimp portion having a cross section formed into a U-shape by a bottom plate and a pair of conductor crimp pieces provided to extend on both sides of the bottom plate and crimped to wrap a conductor of an electric wire disposed on an inner surface of the bottom plate, wherein the conductor crimp portion is crimped and connected to the conductor and includes serrations at respective lattice points of a lattice assumed in an inner surface of the conductor crimp portion and obliquely crossing in a longitudinal direction of the conductor, the serrations being consisted of cylindrical recesses having the same shape.

According to the above aspect, a lattice obliquely crossing in the longitudinal direction of the conductor is assumed on the inner surface of the conductor crimp portion, and serrations constituted of cylindrical recesses having the same shape are provided at the respective lattice points of the lattice, whereby a length of a serration edge which is an opening edge of the cylindrical recess can be satisfactorily secured. Thus, when the conductor crimp portion is crimped to the conductor, an oxide film of a conductor surface is broken by the serration edge to generate a newly formed surface, and therefore, an area where the conductor and the terminal are firmly adhered to each other can be increased, so that the electrical connection resistance can be stabilized at a low level.

Even when the conductor is formed by twisting and bundling thin wires, damage (for example, the compressibility) to each wire at the time of crimping can be dispersed, and therefore, the mechanical connection strength can be stably enhanced.

A first diagonal line of the lattice may be located along the longitudinal direction of the conductor, a second diagonal line of the lattice may be located perpendicular to the longitudinal direction of the conductor, and a length of the first diagonal line may be equal to a length of the second diagonal line.

According to the above constitution, the serrations are arranged so that the first diagonal line of the lattice is located along the longitudinal direction of the conductor, the second diagonal line of the lattice is located perpendicular to the longitudinal direction of the conductor, and the length of the first diagonal line is the same as the length of the second diagonal line. Accordingly, stable reduction in the electrical connection resistance and stable enhancement of the mechanical connection strength can be performed in a well-balanced manner.

A first diagonal line of the lattice may be located along the longitudinal direction of the conductor, a second diagonal line of the lattice may be located perpendicular to the longitudinal direction of the conductor, and a length of the first diagonal line may be greater than a length of the second diagonal line.

According to the above constitution, the serrations are arranged so that the first diagonal line of the lattice is located along the longitudinal direction of the conductor, the second diagonal line of the lattice is located perpendicular to the longitudinal direction of the conductor, and the length of the first diagonal line is greater than the length of the second diagonal line. Accordingly, the interval between the serrations is narrowed relative to the circumferential direction of the conductor, and the area of the newly formed surface generated by the serration edge increases; therefore, the electrical connection resistance between the conductor and the terminal can be stabilized at a lower level.

Even when the interval between the serrations increases relative to the longitudinal direction of the conductor and the conductor is formed by twisting and bundling thin wires, the damage to each wire at the time of crimping can be further dispersed.

The crimp terminal may further include: an electrical connection portion provided at a front end of the conductor crimp portion and electrically connected to a mating terminal; and a coated crimp portion provided at a rear end of the conductor crimp portion and configured to crimp a coated portion of the electric wire. The conductor crimp portion may include a front end side crimp portion on a side of the electrical connection portion and a rear end side crimp portion on a side of the coated crimp portion, and the serrations may be disposed in the front end side crimp portion.

According to the above constitution, the electrical connection portion electrically connected to a mating terminal is provided at the front end of the conductor crimp portion, and the coated crimping portion crimping the coated portion of the electric wire is provided at the rear end of the conductor crimp portion. Thus, the front end side crimp portion contributes to the reduction in the electrical connection resistance between the terminal and the conductor, and therefore, the serrations are arranged so that the first diagonal line of the lattice is located along the longitudinal direction of the conductor, the second diagonal line of the lattice is located perpendicular to the longitudinal direction of the conductor, and the length of the first diagonal line is greater than the length of the second diagonal line, whereby the electrical connection resistance between the conductor and the terminal can be more effectively stabilized at a low level.

A first diagonal line of the lattice may be located along the longitudinal direction of the conductor, a second diagonal line of the lattice may be located perpendicular to the longitudinal direction of the conductor, and a length of the first diagonal line maybe smaller than a length of the second diagonal line.

According to the above constitution, the serrations are arranged so that the first diagonal line of the lattice is located along the longitudinal direction of the conductor, the second diagonal line of the lattice is located perpendicular to the longitudinal direction of the conductor, and the length of the first diagonal line is smaller than the length of the second diagonal line. Accordingly, the interval between the serrations increases relative to the circumferential direction of the conductor, and even when the conductor is formed by twisting and bundling thin wires, damage to each wire at the time of crimping can be further dispersed.

The interval between the serrations is narrowed relative to the longitudinal direction of the conductor, and the number of contact points between the conductor and the serration edge increases at the time of crimping; therefore, the mechanical connection strength between the conductor and the terminal can be further enhanced and stabilized.

The crimp terminal may further include: an electrical connection portion provided at a front end of the conductor crimp portion and electrically connected to a mating terminal; and a coated crimp portion provided at a rear end of the conductor crimp portion and configured to crimp a coated portion of the electric wire. The conductor crimp portion may include a front end side crimp portion on a side of the electrical connection portion and a rear end side crimp portion on a side of the coated crimp portion, and the serrations may be disposed in the rear end side crimp portion.

According to the above constitution, the electrical connection portion electrically connected to a mating terminal is provided at the front end of the conductor crimp portion, and the coated crimping portion crimping a portion with a coating of the electric wire is provided at the rear end of the conductor crimp portion. Thus, the rear end side crimp portion contributes to the enhancement of the mechanical connection between the terminal and the conductor, and therefore, the serrations are arranged so that the first diagonal line of the lattice is located along the longitudinal direction of the conductor, the second diagonal line of the lattice is located perpendicular to the longitudinal direction of the conductor, and the length of the first diagonal line is smaller than the length of the second diagonal line, whereby the mechanical connection strength between the conductor and the terminal can be more effectively enhanced and stabilized.

DESCRIPTION OF EMBODIMENTS

Hereinafter, embodiments of the present invention will be described with reference to the drawings.

First Embodiment

A first embodiment of the present invention will be described with reference to FIGS. 4 to 6.

Figure 1:
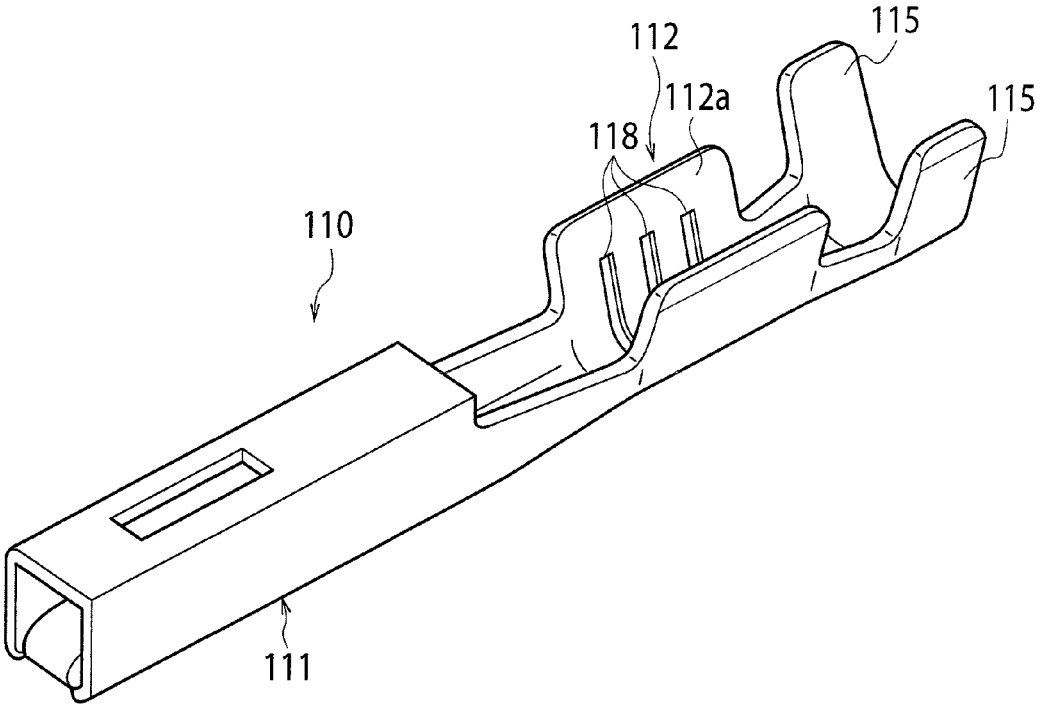
FIG.1 RELATED ART
FIG. 1 is a perspective view illustrating a conventional crimp terminal.
Figure 2:
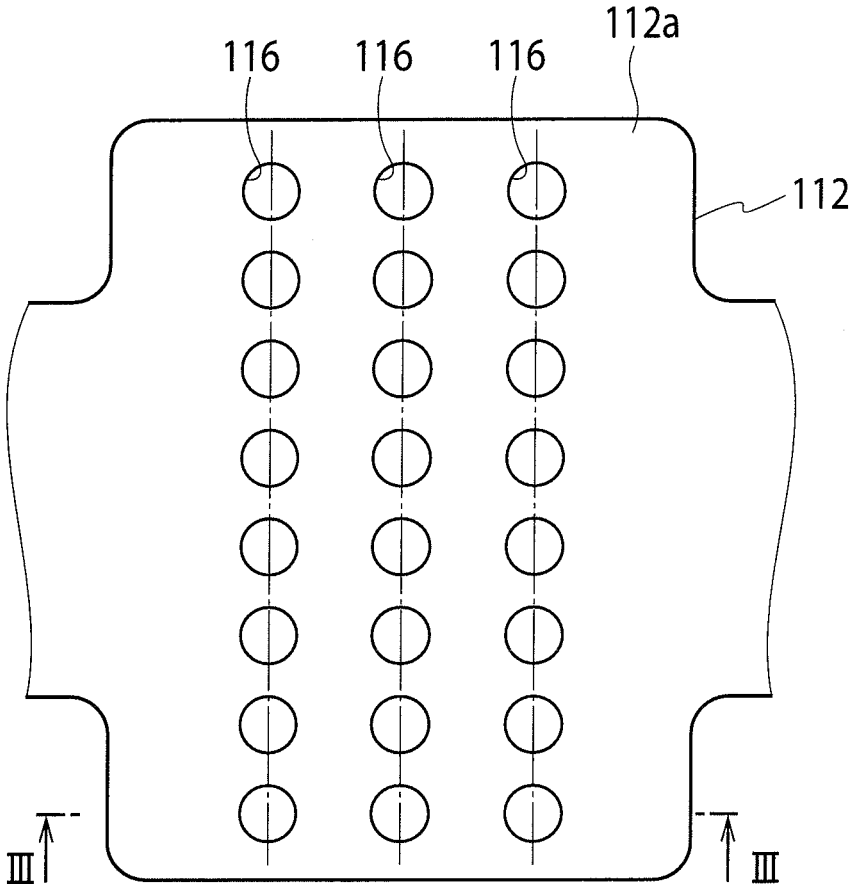
FIG. 2 is a development view of a relevant portion of a conductor crimp portion of the conventional crimp terminal.
Figure 3:
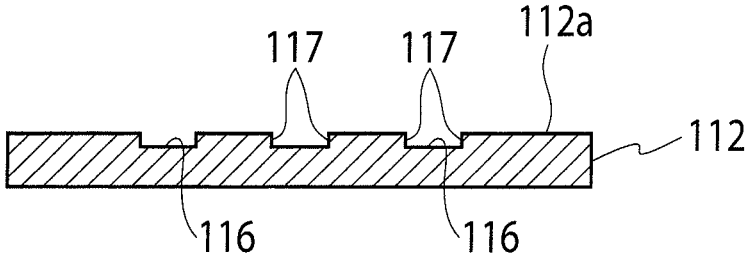
FIG. 3 is a cross-sectional view along a III-III line of FIG. 2.
Figure 4:
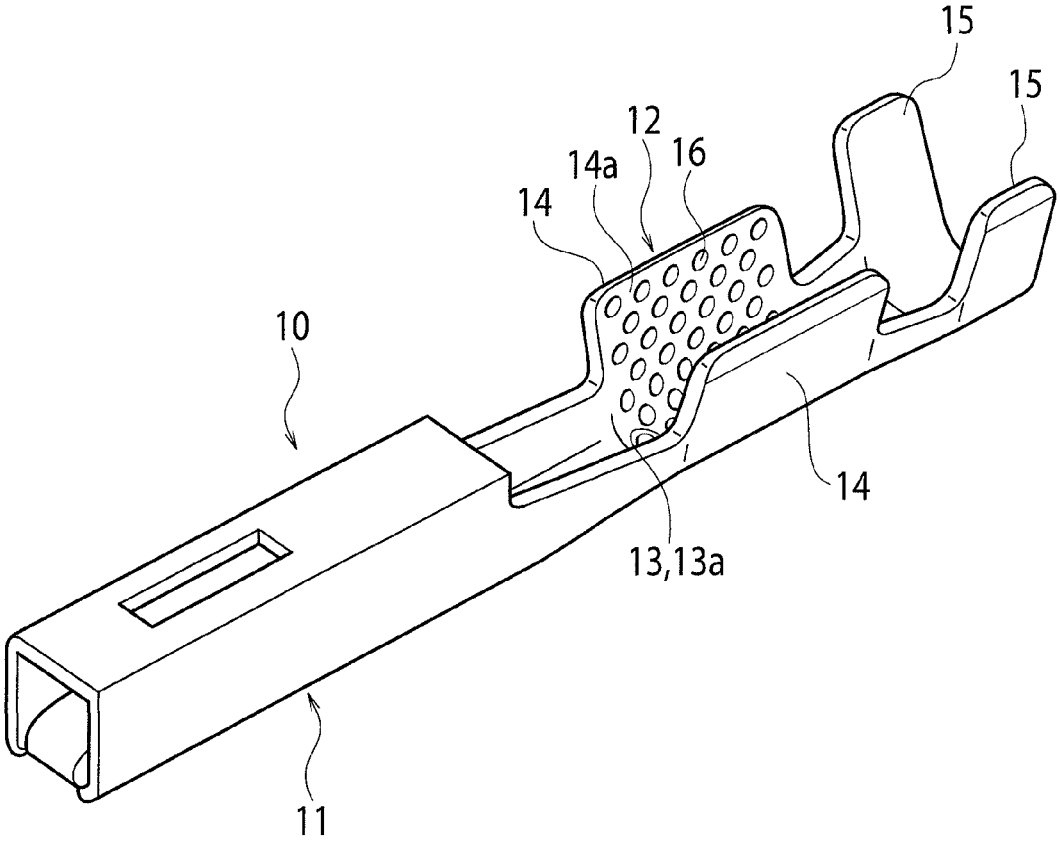
FIG. 4 is a perspective view illustrating a crimp terminal according to a first embodiment of the present invention.

As illustrated in FIG. 4, a crimp terminal 10 is manufactured by pressing a tinned copper or copper-alloy plate material. The crimp terminal 10 has an electrical connection portion 11 provided at a front end portion and electrically connected to a mating terminal, a conductor crimp portion 12 provided immediately behind the connection portion 11, wrapped around and crimping to the outer circumference of an end of a conductor Wa of an electric wire W, and electrically connected to the conductor Wa, and a coated crimping portion 15 provided further behind the conductor crimp portion 12 and wrapped around the outer circumference of a portion with a coating Wb of the electric wire W and crimped.

The electric wire W is constituted of the conductor (core wire) Wa formed by twisting a plurality of wires Wc together and the insulating coating Wb coating the conductor Wa. The crimp terminal 10 is connected to an end (forward end) of the conductor Wa of the electric wire W so that the front-back direction coincides with the longitudinal direction of the conductor Wa of the electric wire W.

The conductor crimp portion 12 is formed to have a substantially U-shaped cross section by a bottom plate 13 continued from the electrical connection portion 11 and a pair of right and left conductor crimping pieces 14, 14 provided to extend on both the right and left sides of the bottom plate 13 and crimped so as to wrap the conductor Wa disposed on an inner surface 13*a* of the bottom plate 13.

Figure 5:
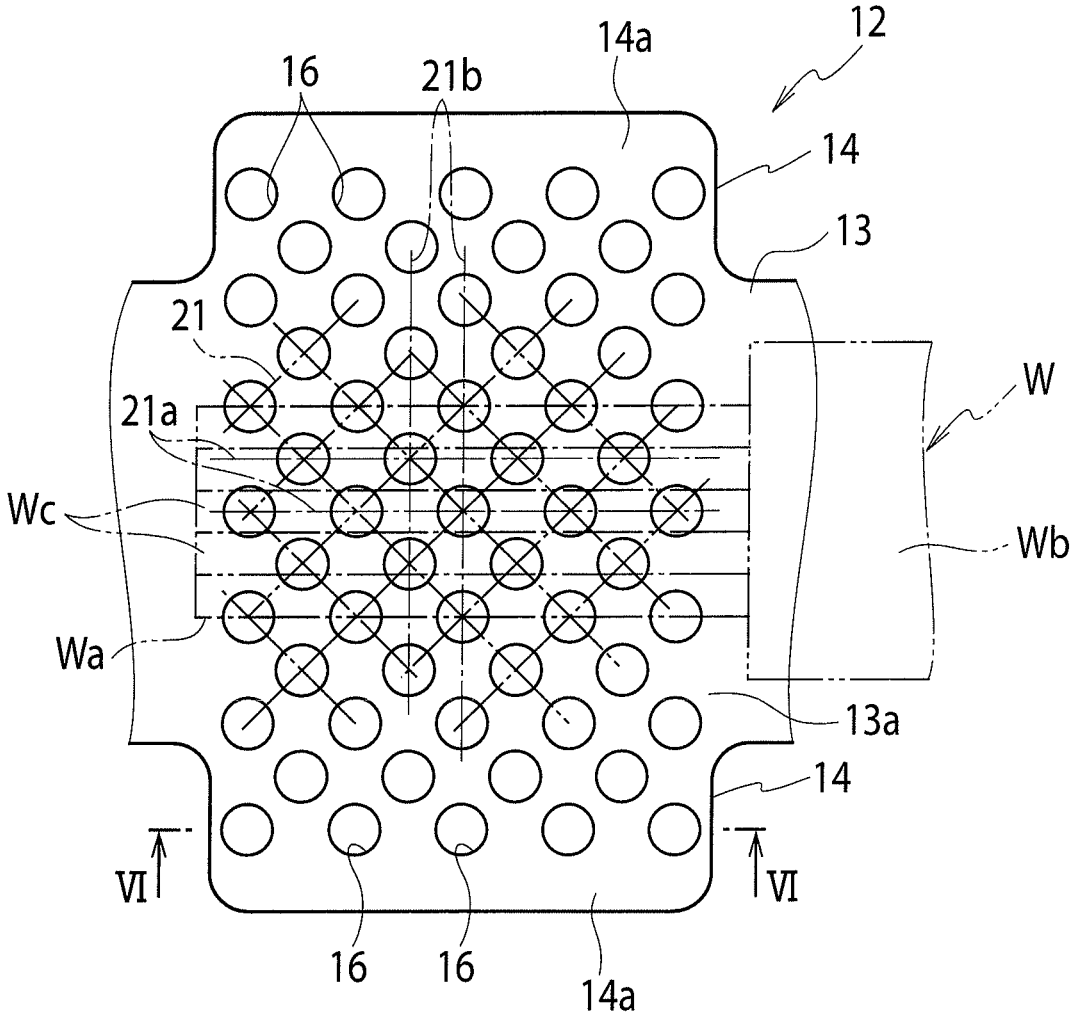
FIG. 5 is a development view of a relevant portion of a conductor crimp portion of the crimp terminal according to the first embodiment of the present invention.

A lattice 21 illustrated by the two-dot chain lines in FIG. 5 and obliquely crossing in the longitudinal direction of the conductor Wa is assumed in an inner surface of the conductor crimp portion 12, that is, in a range from the inner surface 13*a* of the bottom plate 13 to an inner surface 14*a* of the conductor crimping piece 14. As illustrated in FIGS. 5 and 6, serrations 16 constituted of cylindrical recesses having the same shape (the same depth and the same radius) are provided at the respective lattice points of the assumed lattice 21. In the present embodiment, the lattice 21 is assumed to be a square lattice in which one diagonal lines (first diagonal lines) 21*a* of the lattice are located along the longitudinal direction of the conductor, the other diagonal lines (second diagonal lines) 21*b* are perpendicular to the longitudinal direction of the conductor and located along the circumferential direction of the conductor Wa, and the length of the diagonal line 21*a* is the same as the length of the diagonal line 21*b*. The serrations 16 are arranged around the respective lattice points.

The conductor Wa exposed by stripping an end of the electric wire W is put on the bottom plate 13 of the conductor crimp portion 12 of the crimp terminal 10 constituted as above, and a pair of the conductor crimping pieces 14, 14 is crimped to wrap the conductor Wa. At this time, the inner surface of the conductor crimp portion 12 and the conductor Wa are strongly in press contact with each other by a pressing force applied from outside, and the conductor Wa extends along the longitudinal direction between the serrations 16 and, at the same time, is press-fitted into the serrations 16.

Figure 6:
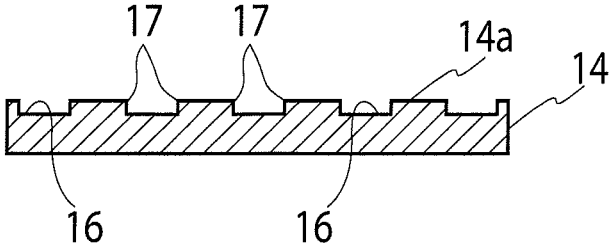
FIG. 6 is a cross-sectional view along a VI-VI line of FIG. 5.

When the conductor Wa is press-fitted into the serrations 16, an oxide film of a surface of the conductor Wa is broken by serration edges 17 of FIG. 6 to expose a newly formed surface. The newly formed surface and the serrations 16 are adhered firmly to each other, whereby an electrical connection resistance can be reduced. The conductor Wa is press-fitted into the serrations 16 to be caught by the serration edges 17, so that mechanical connection strength can be enhanced.

Since the serrations 16 are formed on the entire inner surface of the conductor crimp portion 12, especially when the conductor Wa is formed by twisting and bundling the thin wires Wc, damage (for example, compressibility) to each of the wires Wc at the time of crimping can be dispersed. Thus, the mechanical connection strength can be stably enhanced, and, at the same time, the length of the serration edge 17 can be satisfactorily secured, so that a newly formed surface can be generated over a wide range of the surface of the conductor Wa; therefore, the electrical connection resistance can be stabilized at a low level.

The serrations 16 are arranged at the respective lattice points of the lattice 21 assumed to be a square lattice in which the diagonal lines 21*a* are located along the longitudinal direction of the conductor Wa and the diagonal lines 21*b* are located along the circumferential direction of the conductor Wa, whereby stable reduction in the electrical connection resistance and stable enhancement of the mechanical connection strength can be performed in a well-balanced manner.

The interval of the lattice 21 and the hole diameter and the depth of the serration 16 are suitably set according to, for example, the material, the wire diameter, and the number of the wires Wc constituting the conductor Wa.

Second Embodiment

Next, a second embodiment of the present invention will be described with reference to FIGS. 7 and 8. The components similar to those of the first embodiment are designated by the same reference numerals, and detailed descriptions will not be repeated. The second embodiment is widely different from the first embodiment in the arrangement pattern of the serrations 16 formed in the inner surface of the conductor crimp portion 12.

Figure 7:
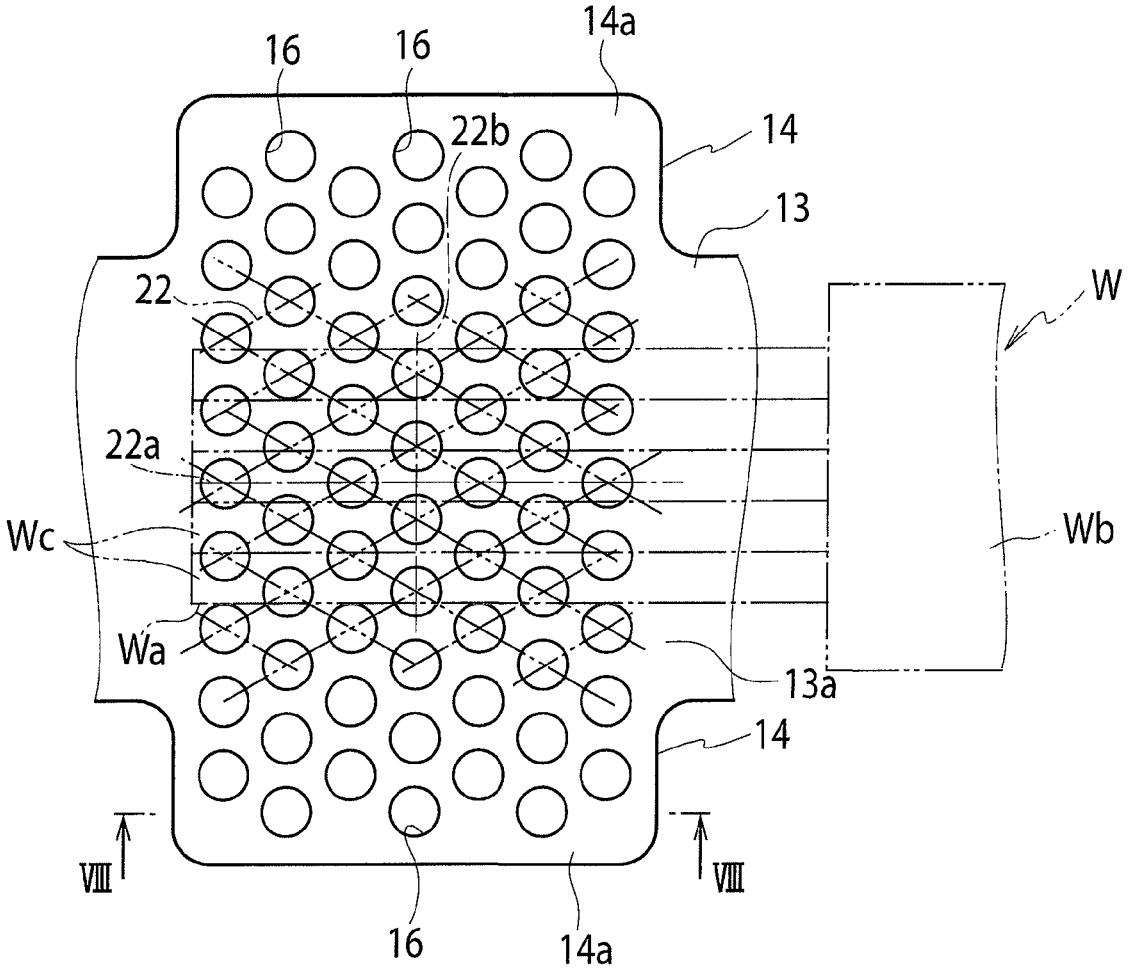
FIG. 7 is a development view of a relevant portion of a conductor crimp portion of a crimp terminal according to a second embodiment of the present invention.
Figure 8:
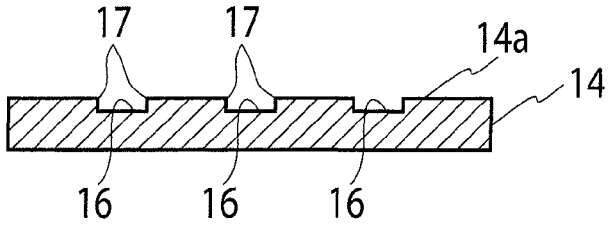
FIG. 8 is a cross-sectional view along a VIII-VIII line of FIG. 7.

In the present embodiment, as illustrated in FIG. 7, a lattice 22 in which serrations 16 are arranged is assumed to be a horizontally long rhombic lattice in which one diagonal lines (first diagonal lines) 22*a* of the lattice 22 are located along the longitudinal direction of the conductor, the other diagonal lines (second diagonal lines) 22*b* are located perpendicular to the longitudinal direction of a conductor Wa, and the length of the diagonal line 22*a* is greater than the length of the diagonal line 22*b*. As illustrated in FIGS. 7 and 8, the serrations 16 are arranged around the respective lattice points of the lattice 22 thus assumed. Namely, the serrations 16 are arranged at wide intervals along the longitudinal direction and at narrow intervals along the circumferential direction.

The process for crimping the conductor crimp portion 12 to an end of an electric wire W is similar to that of the first embodiment.

In the above constitution, the serrations 16 are arranged so that the diagonal lines 22*a* of the lattice 22 are located along the longitudinal direction of the conductor Wa, the diagonal lines 22*b* are located perpendicular to the longitudinal direction of the conductor Wa, and the length of the diagonal line 22*a* is greater than the length of the diagonal line 22*b*. According to this constitution, the interval between the serrations is narrowed relative to the circumferential direction of the conductor Wa, and the area of the newly formed surface generated by serration edges 17 increases; therefore, the electrical connection resistance between the conductor Wa and the terminal can be stabilized at a lower level.

In the above constitution, the serrations 16 are closely arranged along the circumferential direction. Thus, when the conductor Wa is formed by twisting and bundling thin wires Wc, the serration edges 17 are evenly crimped to the respective wires Wc, and, at the same time, the interval between the serrations 16 increases in the longitudinal direction of the conductor Wa; therefore, damage to the respective wires Wc at the time of crimping can be dispersed. Accordingly, this serration arrangement pattern is suitable when the mechanical connection strength between the conductor Wa and the terminal is required to be satisfied while suppressing the damage to the wire Wc due to, for example, that the wire diameter of the wire Wc constituting the conductor Wa is small, and, in addition, the electrical connection resistance between the conductor Wa and the terminal is required to be stabilized at a lower level.

Third Embodiment

Next, a third embodiment will be described with reference to FIGS. 9 and 10. The components similar to those of the first embodiment are designated by the same reference numerals, and detailed descriptions will not be repeated. The third embodiment is widely different from the first embodiment in the arrangement pattern of the serrations 16 formed in the inner surface of the conductor crimp portion 12.

Figure 9:
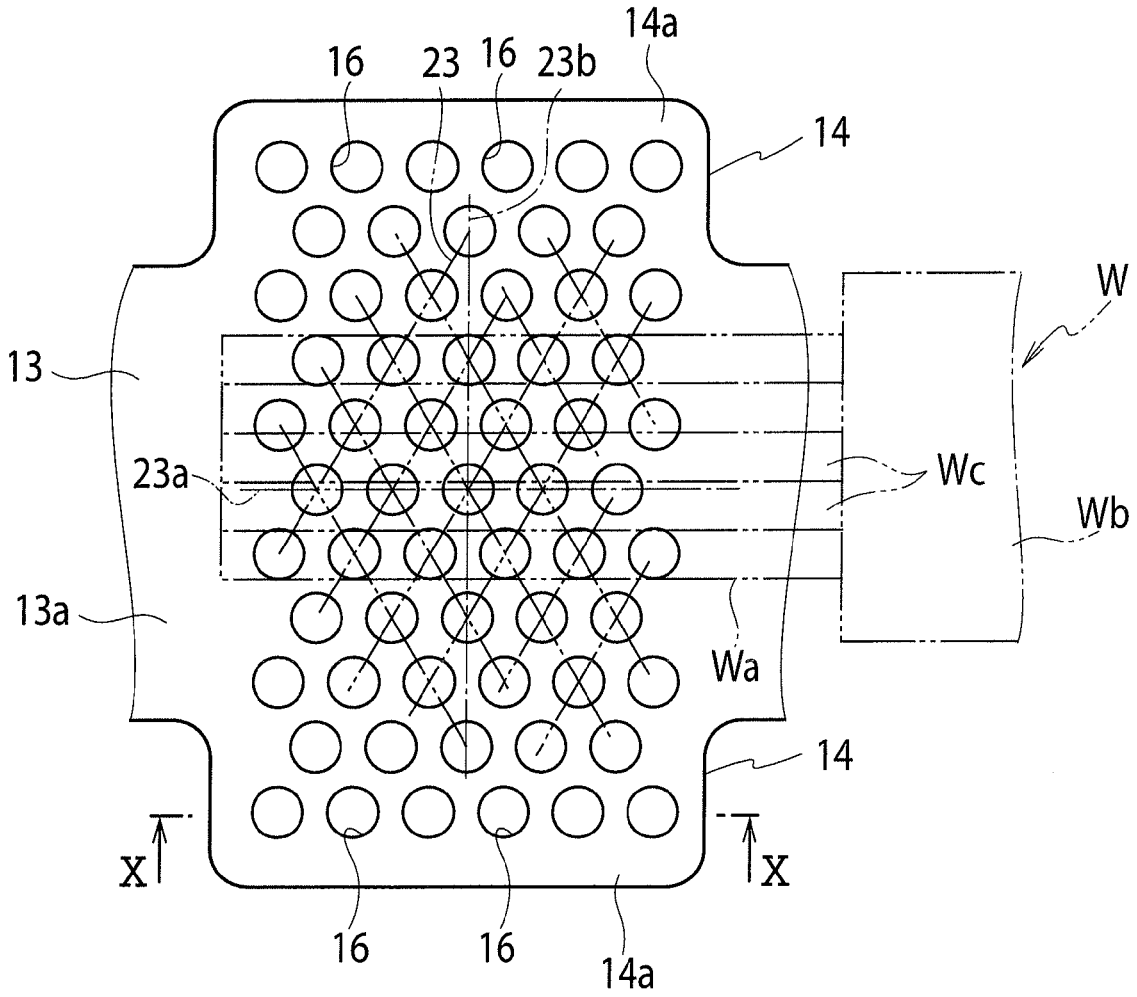
FIG. 9 is a development view of a relevant portion of a conductor crimp portion of a crimp terminal according to a third embodiment of the present invention.
Figure 10:
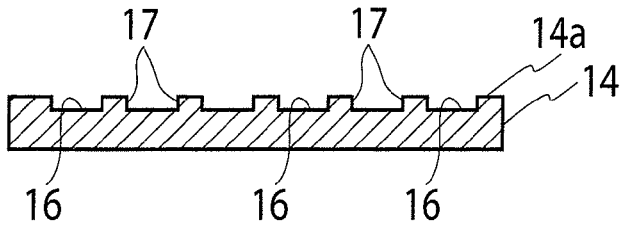
FIG. 10 is a cross-sectional view along a X-X line of FIG. 9.

In the present embodiment, as illustrated in FIG. 9, a lattice 23 in which serrations 16 are arranged is assumed to be a vertically long rhombic lattice in which one diagonal lines (first diagonal lines) 23*a* of the lattice 23 are located along the longitudinal direction of the conductor Wa, the other diagonal lines (second diagonal lines) 23*b* are located perpendicular to the longitudinal direction of the conductor Wa, and the length of the diagonal line 23*a* is smaller than the length of the diagonal line 23*b*. As illustrated in FIGS. 9 and 10, the serrations 16 are arranged around the respective lattice points of the lattice 23 thus assumed. Namely, the serrations 16 are arranged at narrow intervals along the longitudinal direction and at wide intervals along the circumferential direction.

The process for crimping the conductor crimp portion 12 to an end of an electric wire W is similar to that of the first embodiment.

In the above constitution, the serrations 16 are arranged so that the diagonal lines 23*a* of the lattice 23 are located along the longitudinal direction of the conductor Wa, the diagonal lines 23*b* are located perpendicular to the longitudinal direction of the conductor Wa, and the length of the diagonal line 23*a* is smaller than the length of the diagonal line 23*b*. According to this constitution, the interval between the serrations 16 is narrowed relative to a direction around an axis of the conductor Wa, and the area of the newly formed surface generated by a serration edge 17 increases; therefore, the electrical connection resistance between the conductor Wa and the terminal can be stabilized at a lower level.

In the above constitution, the serrations 16 are closely arranged along the longitudinal direction. Thus, since the number of contact points between the conductor Wa and the serration edge 17 increases along the longitudinal direction at the time of crimping, the mechanical connection strength between the conductor Wa and the terminal can be further enhanced and stabilized, for example, when a load is applied in a direction of pulling out the electric wire W.

Accordingly, the above arrangement pattern of the serrations 16 is suitable for the conductor Wa relatively resistant to mechanical damage, such as a conductor Wa constituted of a single conducting wire and a conductor Wa formed by twisting and bundling a plurality of wires Wc having a relatively large wire diameter, when the electrical connection resistance is required to be reduced while further enhancing the mechanical connection strength between the conductor Wa and the crimp terminal 10.

Fourth Embodiment

Next, a fourth embodiment will be described with reference to FIGS. 11 and 12. The components similar to those of the first embodiment are designated by the same reference numerals, and detailed descriptions will not be repeated. The fourth embodiment is widely different from the first embodiment in the arrangement pattern of the serrations 16 formed in the inner surface of the conductor crimp portion 12.

Figure 11:
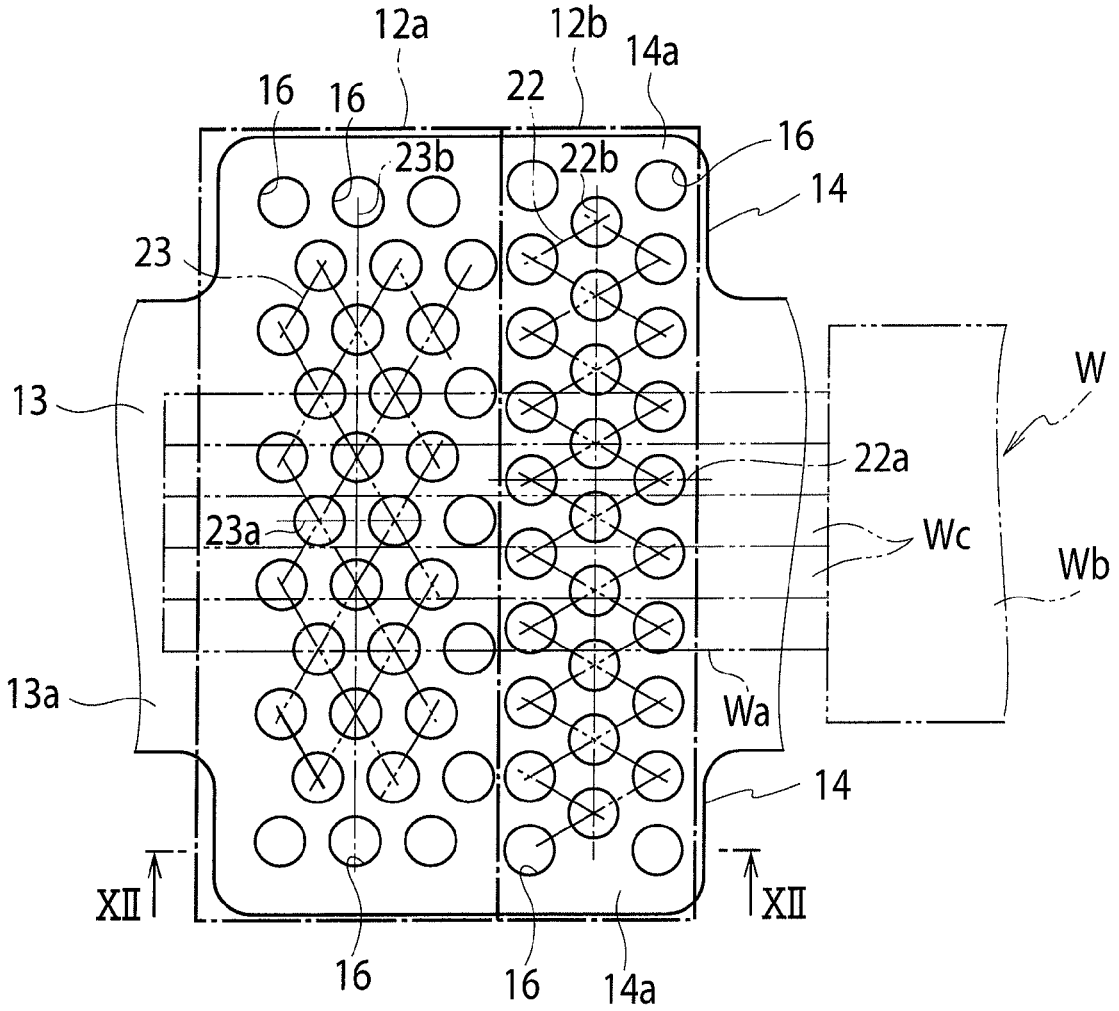
FIG. 11 is a development view of a relevant portion of a conductor crimp portion of a crimp terminal according to a fourth embodiment of the present invention.
Figure 12:
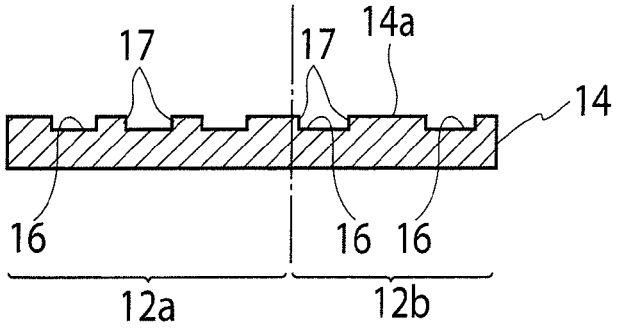
FIG. 12 is a cross-sectional view along a XII-XII line of FIG. 11.

In the present embodiment, as illustrated in FIG. 11, a conductor crimp portion 12 is constituted of a front end side crimp portion 12*a* and a rear end side crimp portion 12*b*, and serrations 16 are arranged on the front end side crimp portion 12*a* and the rear end side crimp portion 12*b* in different arrangement patterns.

When a load is applied in a direction of pulling out an electric wire W from a crimp terminal 10, a large load is applied to the rear end side of the conductor crimp portion 12. Therefore, in the conductor Wa formed by twisting and bundling thin wires Wc, when the serrations 16 causing large damage to the conductor Wa are arranged in the rear end side crimp portion 12*b*, the wires Wc may be broken. Thus, in the rear end side crimp portion 12*b*, the horizontally long rhombic lattice 22 of the second embodiment which is less likely to damage the wires Wc is assumed, and in the front end side crimp portion 12*a*, the vertically long rhombic lattice 23 of the third embodiment which further reduces the electrical connection resistance is assumed. In those lattices, the serrations 16 having the same shape (the same depth and the same radius) are arranged around the respective lattice points.

In the rear end side crimp portion 12*b*, the serrations 16 are arranged so that one diagonal lines 22*a* of the lattice 22 are located along the longitudinal direction of a conductor Wa, the other diagonal lines 22*b* are located perpendicular to the longitudinal direction of the conductor Wa, and the length of the diagonal line 22*a* is smaller than the length of the diagonal line 22*b*. According to this constitution, serration edges 17 are evenly crimped to the wires Wc, and, at the same time, the interval between the serrations 16 increases in the longitudinal direction of the conductor Wa; therefore, the mechanical connection strength can be satisfactorily obtained while dispersing damage to the wires Wc at the time of crimping.

In the front end side crimp portion 12*a*, the serrations 16 are closely arranged along the longitudinal direction of the conductor Wa around the lattice points of the lattice 23. Thus, since the number of contact points between the wires Wc and the serration edges 17 increases along the longitudinal direction of the conductor Wa at the time of crimping, the electrical connection resistance between each of the wires Wc and the crimp terminal 10 is reduced, and the electrical connection resistance between the conductor Wa and the terminal can be stabilized at a lower level.

Accordingly, the above arrangement pattern of the serrations 16 can simultaneously realize the mechanical strength and the reduction in the electrical connection resistance when the crimp terminal 10 is crimped to the conductor Wa which is not relatively strong against mechanical damage, such as a conductor Wa formed by twisting and bundling thin wires Wc.

The arrangement pattern of the serrations 16 in the front end side crimp portion 12*a* and the rear end side crimp portion 12*b* may be replaced according to the constitution of the conductor Wa. For example, when the conductor Wa is constituted of a single conducting wire, or when the wire diameter of each of the wires Wc is relatively large and is resistant to mechanical damage even if the conductor Wa is formed by twisting and bundling a plurality of thin wires Wc, the horizontally long rhombic lattice 22 and the vertically long rhombic lattice 23 may be replaced, or the square lattice 21 of the first embodiment may be disposed in either one of the front end side crimp portion 12*a* and the rear end side crimp portion 12*b*.

Hereinabove, although the embodiments of the present invention have been described, the present invention is not limited to the above embodiments and may be variously modified.

The invention claimed is:

1. A crimp terminal comprising:

a conductor crimp portion having a cross section formed into a U-shape by a bottom plate and a pair of conductor crimp pieces provided to extend on both sides of the bottom plate and crimped to wrap a conductor of an electric wire disposed on an inner surface of the bottom plate;

an electrical connection portion provided at a front end of the conductor crimp portion and being electrically connectable to a mating terminal; and a coated crimp portion provided at a rear end of the conductor crimp portion and configured to crimp a coated portion of the electric wire, wherein the conductor crimp portion is crimped and connected to the conductor and includes serrations at respective lattice points of a lattice assumed in an inner surface of the conductor crimp portion and obliquely crossing in a longitudinal direction of the conductor, the serrations being consisted of cylindrical recesses having the same shape, wherein a first diagonal line of the lattice is located along the longitudinal direction of the conductor, wherein a second diagonal line of the lattice is located perpendicular to the longitudinal direction of the conductor, wherein the conductor crimp portion includes a front end side crimp portion on a side of the electrical connection portion and a rear end side crimp portion on a side of the coated crimp portion, wherein the serrations include first serrations having a length of the first diagonal line greater than a length of the second diagonal line, and second serrations having a length of the first diagonal line smaller than a length of the second diagonal line, wherein the first serrations are disposed in the rear end side crimp portion, and wherein the second serrations are disposed in the front end side crimp portion.

* * * * *